US011313518B2

(12) United States Patent
Wang et al.

(10) Patent No.: US 11,313,518 B2
(45) Date of Patent: Apr. 26, 2022

(54) LIGHT EMITTING APPARATUS HAVING ANTENNA LOCATED IN ACCOMMODATION SPACE FORMED BY HOUSING AND CONTROL MODULE

(71) Applicant: EPISTAR CORPORATION, Hsinchu (TW)

(72) Inventors: Sheng-Bo Wang, Hsinchu (TW); Chang-Hsieh Wu, Hsinchu (TW); Yi-Chao Lin, Hsinchu (TW); Yao-Zhong Liu, Hsinchu (TW); Jai-Tai Kuo, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 17/105,834

(22) Filed: Nov. 27, 2020

(65) Prior Publication Data

US 2021/0164621 A1 Jun. 3, 2021

(30) Foreign Application Priority Data

Nov. 28, 2019 (TW) ..... 108143475

(51) Int. Cl.

| | |
|---|---|
| ***F21K 9/238*** | (2016.01) |
| ***F21V 23/00*** | (2015.01) |
| ***F21V 7/05*** | (2006.01) |
| ***H05B 47/19*** | (2020.01) |
| ***F21V 7/00*** | (2006.01) |
| ***F21K 9/232*** | (2016.01) |

(52) U.S. Cl.

CPC ..... *F21K 9/238* (2016.08); *F21K 9/232* (2016.08); *F21V 7/0066* (2013.01); *F21V 7/05* (2013.01); *F21V 23/003* (2013.01); *H05B 47/19* (2020.01)

(58) Field of Classification Search

CPC ..... F21K 9/232; F21K 9/238; H05B 47/19; H05B 47/195; F21V 7/0066; F21V 7/05; F21V 23/003; F21V 23/006; F21V 23/008

See application file for complete search history.

(56) References Cited

U.S. PATENT DOCUMENTS

| | | | | |
|---|---|---|---|---|
| 10,047,912 | B2 * | 8/2018 | Bosua | H05B 47/19 |
| 2019/0056072 | A1 * | 2/2019 | Gielen | F21V 23/002 |
| 2021/0088189 | A1 * | 3/2021 | You | F21K 9/238 |
| 2021/0100080 | A1 * | 4/2021 | Chen | H05B 45/325 |

* cited by examiner

*Primary Examiner* — Alan B Cariaso

(74) *Attorney, Agent, or Firm* — Muncy. Geissler, Olds & Lowe, P.C.

(57) ABSTRACT

A light emitting apparatus includes a housing, a connector, a light source, a control module board, and an antenna. The housing includes an inner space. The light source is located in the inner space. The control module board is located in the connector, wherein an accommodation space is formed by the housing and the control module board. The antenna is located in the accommodation space.

9 Claims, 6 Drawing Sheets

LIGHT EMITTING APPARATUS HAVING ANTENNA LOCATED IN ACCOMMODATION SPACE FORMED BY HOUSING AND CONTROL MODULE

CROSS-REFERENCE TO RELATED APPLICATIONS

This application claims priority to the benefit of Taiwan Patent Application Number 108143475 filed on Nov. 28, 2019, and the entire contents of which are hereby incorporated by reference herein in its entirety.

BACKGROUND

Technical Field

The present application relates to a light emitting apparatus, more specifically, to a light emitting apparatus including a connector, a control module board and an antenna, wherein the antenna protrudes from the connector.

Description of the Related Art

A light emitting apparatus, e.g., a lamp, for lighting is usually distant from a user while the switch of the lamp is disposed at the lamp or the switches of several lamps are arranged collectively at one location so the user has to move to that spot when the user wants to control the lamp(s). In a different scenario, switches of the plurality of lamps are arranged at different spots respectively so the user may need to move to different spots for control purpose. Therefore, how to control one or more lamps without moving around becomes an important design concern.

SUMMARY OF THE DISCLOSURE

The present application discloses a light emitting apparatus including a housing, having an inner space; a connector, connected to the housing; a light source, located in the inner space; a control module board, located in the connector, wherein an accommodation space is formed by the housing and the control module board; and an antenna, located in the accommodation space.

DETAILED DESCRIPTION OF THE EMBODIMENTS

To better and concisely explain the disclosure, the same name or the same reference number given or appeared in different paragraphs or figures along the specification should has the same or equivalent meanings while it is once defined anywhere of the disclosure.

Figure 1A:
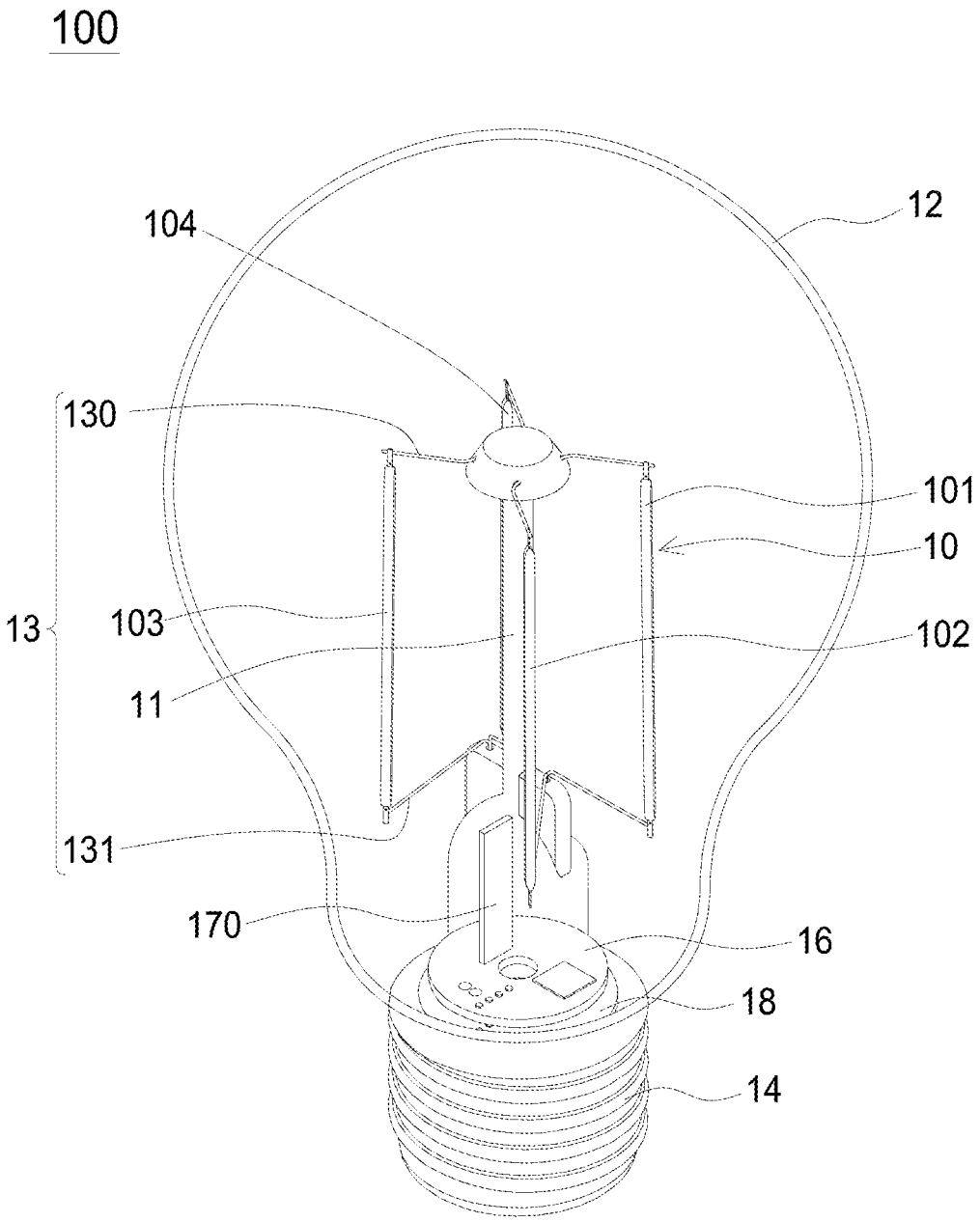
FIG. 1A shows a stereogram of a lamp in accordance with an embodiment of the present application.
Figure 1B:
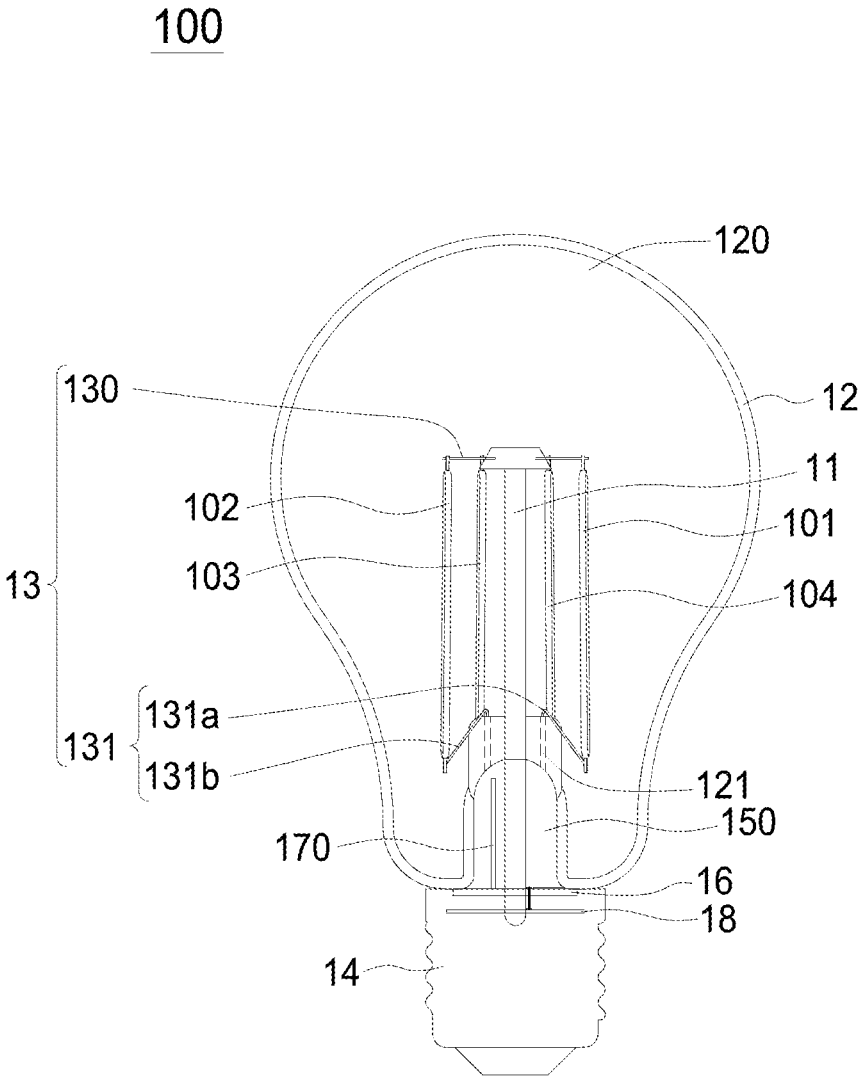
FIG. 1B shows a perspective view of a lamp in accordance with an embodiment of the present application.

FIG. 1A shows a stereogram of a lamp in accordance with an embodiment of the present application. FIG. 1B shows a perspective view of a lamp in accordance with an embodiment of the present application. Some minor details are omitted in FIG. 1B for simplicity. Referring to FIG. 1A, a lamp 100 includes a supporting pillar 11, a housing 12, an antenna 170, a connecting part 13 including an upper connecting part 130 and a lower connecting part 131, a connector 14, a control module board 16, a light source 10 including a first light emitting component 101, a second light emitting component 102, a third light emitting component 103 and a fourth light emitting component 104 and a driving circuit board 18 located in the connector 14 (referring to FIG. 1B). The connector 14 can be electrically connected to the driving circuit board 18 via a wire (not shown in the drawings). The light source 10 obtains electricity from an external power source via the connector 14, the wire and the driving circuit board 18. In addition, the control module board 16 is capable of controlling the driving circuit board 18 to adjust a current provided to the light source 10. The lamp 100 can receive an external control signal by the antenna 170. The control module board 16 generates an internal control signal based on the received control signal to change a characteristic of a current signal outputted by the driving circuit board 18 to further change a lighting characteristic of the lamp. The current characteristic can be a pulse shape, a peak value, a root-mean-square value or duty ratio of the current signal. The lighting characteristic can be a light color, a color temperature, a luminance or a flicker frequency.

Based on the above description, the antenna 170 receives an external control signal and provides the external control signal to the control module board 16, and the control module board 16 generates an internal control signal for the driving circuit board 18 based on the external control signal. The driving circuit board 18 provides a current signal with adjusted current characteristic based on the internal control signal. The light source 10 provides a light with corresponding lighting characteristic based on the current signal.

The light source 10 includes a first light emitting component 101, a second light emitting component 102, a third light emitting component 103 and a fourth light emitting component 104. In one embodiment, the light emitting components 101~104 are electrically connected in series. In other embodiments, the light emitting components 101~104 can be electrically connected in other ways rather than in series. In one example, the light emitting components 101~104 are electrically connected in parallel. In another example, two (e.g., first light emitting components 101 and second light emitting component 102) of the light emitting components 101~104 are electrically connected in parallel as one set while the other two (e.g., third light emitting components 103 and fourth light emitting component 104) are electrically connected in parallel as another set, and the two sets are electrically connected in series. In another example, two (e.g., first light emitting components 101 and second light emitting component 102) of the light emitting components 101~104 are electrically connected in series as one set while the other two (e.g., third light emitting components 103 and fourth light emitting component 104) are electrically connected in series as another set, and the two sets are electrically connected in parallel.

Each of the first light emitting component 101, the second light emitting component 102, the third light emitting component 103 and the fourth light emitting component 104 includes one or more light emitting diodes. In one embodiment, each of the first light emitting component 101 and the second light emitting component 102 has a plurality light emitting diodes electrically connected in series and configured to provide lights of a same light color. In one embodiment, each of the light emitting diodes includes one or more semiconductor layers composed of III-V group semiconductor material, such as $Al_xIn_yGa_{(1-x-y)}N$ or $Al_xIn_yGa_{(1-x-y)}P$, wherein $0 \leq x, y \leq 1$: $(x+y) \leq 1$, for emitting non-coherent light. Based on the material composition, the light-emitting diode can emit a red light with a peak wavelength or dominant wavelength of 610~650 nm; emit a green light with a peak wavelength or dominant wavelength of 495~570 nm; emit a blue light with a peak wavelength or dominant wavelength of 450~495 nm; emit a purple light with a peak wavelength or dominant wavelength of 400~440 nm, or emit a UV light with a peak wavelength of 200~400 nm. In one embodiment, the light emitting diode includes a substrate and a light emitting layer formed on the substrate. In the light emitting components 101~104, the light emitting diode can be covered by a wavelength conversion material. The wavelength conversion material can be a quantum dot material or a phosphor material. The phosphor material includes yellow-greenish phosphor, red phosphor, or blue phosphor. The yellow-greenish phosphor includes YAG, TAG, silicate, vanadate, alkaline-earth metal selenide, or metal nitride. The red phosphor includes fluoride ($K_2TiF_6:Mn^{4+}$, $K_2SiF_6:Mn^{4+}$), silicate, vanadate, alkaline-earth metal sulfide, oxynitride, or a mixture of tungstate and molybdate. The blue phosphor includes $BaMgAl_{10}O_{17}:Eu^{2+}$. The quantum dot material can be ZnS, ZnSe, ZnTe, ZnO, CdS, CdSe, CdTe, GaN, GaP, GaSe, GaSb, GaAs, AlN, AlP, AlAs, InP, InAs, Te, PbS, InSb, PbTe, PbSe, SbTe, ZnCdSeS, CuInS, $CsPbCl_3$, $CsPbBr_3$ or $CsPbI_3$. In one embodiment, the first light emitting component 101 including the wavelength conversion material that can provide a white light which has a color temperature between 10000K~20000K and has a chromaticity coordinates (x, y) on CIE 1931 chromaticity diagram, wherein $0.27 \leq x \leq 0.285$:$0.23 \leq y \leq 0.26$. In one embodiment, the white light has a color temperature of 2200K~6500K (e.g., 2200K, 2400K, 2700K, 3000K, 5700K, 6500K), and the chromaticity coordinates (x, y) is within a seven-step MacAdam ellipse on CIE 1931 chromaticity diagram. An equivalent forward voltage of the light source 10 is within 110V~280V (e.g., 130V, 200V or 260V). In one embodiment, the light source 10 is an LED light emitting component. Related information of the LED light emitting component can be referred to TW application with application number of 107123460.

The control module board 16 is configured to receive the external control signal and generate the internal control signal for the driving circuit board 18. For example, the control module board 16 receives a Bluetooth signal, a Wi-Fi signal, an infrared signal or another signal of other communication protocol and generates the internal control signal which is inputted to the driving circuit board 18. In one embodiment, the control module board 16 includes a data storage device, such as a dynamic random access memory (DRAM), a synchronous dynamic random access memory (SDRAM) or a flash memory. In one embodiment, the control module board 16 includes a control chip generating the internal control signal based on the external control signal. The control chip includes a Bluetooth signal processing chip or an infrared signal processing chip.

The driving circuit board 18 can convert a voltage provided by an external power source and adjust a characteristic of an output current based on the internal control signal. As for the voltage conversion, the driving circuit board 18 converts an AC voltage from external to a DC voltage and generate a current inputted to the light source 10. In one embodiment, light circuit board 18 includes a bridge rectifier, a filter and a transistor. The transistor can be a high electron mobility transistor (HEMT) or a metal-oxide-semiconductor field-effect transistor (MOSFET). In one embodiment, the driving circuit board 18 adjusts the characteristic of the output current based on the internal control signal from the control module board 16 to change the optical characteristic of the light provided by the light source 10. The optical characteristic and the adjusted current characteristic can be referred to the above description and are not repeated.

FIG. 1B shows a perspective view of a lamp in accordance with an embodiment of the present application. In the lamp 100, the housing 12 has an inner space 120 for accommodating the supporting pillar 11, the light source 10, the upper connecting part 130 and the lower connecting part 131. The supporting pillar 11 has two ends physically connected to the light source 10 by the upper connecting part 130 and the lower connecting part 131. The lower connecting part 131 includes a first lower connecting portion 131*a* and a second lower connecting portion 131*b*. The light source 10 is electrically connected to the driving circuit board 18 via the first lower connecting portion 131*a* and the second lower connecting portion 131*b*. For example, a current provided by the driving circuit board 18 flows through the second lower connection portion 131*b* and enters the second light emitting component 102, and then the current flows through the upper connecting part 130 and enters the first light emitting component 101. The current flows back to the driving circuit board 18 through the first lower connection portion 131*a* after passing the first light emitting component 101 so a current loop is formed accordingly. Each of the upper connecting part 130 and the lower connecting part 131 includes one conductive material (e.g., metal). The supporting pillar 11 includes a transparent material (e.g., glass) with a conductive structure penetrating the transparent material and connected to the upper connecting part 130. The housing 12 includes first through holes 121. The lower connecting part 131 is electrically connected to power contacts 180 on the driving circuit board 18 (referring to FIG. 2B) via the second through holes 160 (referring to FIG. 2A) of the control module board 16. Thus, the driving circuit board 18 is capable of providing a current to the light source 10 via the lower connecting part 131. In one embodiment, there is metal material disposed in the through holes to contact the lower connecting part 131 directly. The supporting pillar 11 extends downwardly to the outside of the housing 12 and passes a third through hole 161 of the control module board 16 to directly contact the light circuit board 18. In one embodiment, the driving circuit board 18 includes a receiving part 181 for the supporting pillar 11 to penetrate the driving circuit board 18. An accommodation space 150 composed by the arrangement of the housing 12 and the control module board 16 is formed between the housing 12 and the control module board 16. The antenna 170 and a part of the supporting pillar 11 are in the accommodation space 150. Viewing from FIG. 1B, the antenna 170 protrudes form the control module board 16 upwardly and to the outside of the connector 14. A part of the antenna 170 is not surrounded by the connector 14 so that the antenna 170 is not shield by the connector 14 which includes metal material, and thus the antenna 170 is capable of transmitting or receiving wireless signal stably.

In one embodiment, the antenna 170 includes an antenna substrate and a metal wire on the antenna substrate. The antenna substrate can be a printed circuit board or a substrate including polyethylene terephthalate (PET). The metal wire includes copper. In another embodiment, the antenna 170 includes an insulative reflecting layer covering the antenna substrate for reflecting the light provide by the light source and reducing the volume of light absorbed by the antenna 170. As a result, lighting attenuation is eased.

Figure 2A:
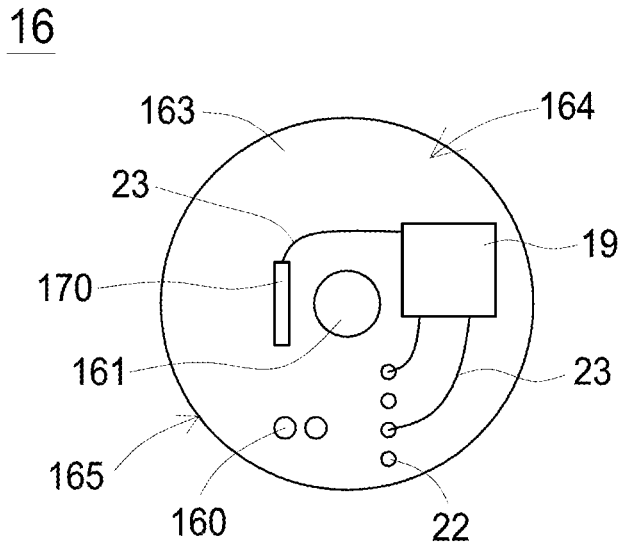
FIG. 2A shows a top view of a control module board in accordance with an embodiment of the present application.

FIG. 2A shows a top view of a control module board in accordance with an embodiment of the present application. Referring to FIG. 2A, the control module board 16 includes a substrate 163, second through holes 160, a third through hole 161, a control chip 19, traces 23 and ejector pins 22. The antenna 170 is disposed on the control module board 16. The substrate 163 includes a first upper surface 164 and a first lower surface 165 opposite to the first upper surface 164. The traces 23 on the first upper surface 164 is electrically connected to the control chip 19, antenna 170 and the ejector pins 22. The second through holes 160 and the third through hole 161 penetrate the substrate 163 and the upper connecting part 131 passes the second through holes 160. Thus, the upper connecting part 131 is electrically connected to the driving circuit board 18. Referring to FIG. 1A, the supporting pillar 11 passes the third through hole 161 and thus directly contacts the driving circuit board 18. The control chip 19 is disposed on the first upper surface 164. One of the traces 23 connects the chip 19 and the antenna 170. The control chip 19 receives an external control signal received by the antenna 170 and converts the external control signal to the internal control signal. The internal control signal is provided to the driving circuit board 18 via the traces 23 and the ejector pins 22. In one embodiment, the signal received by the antenna is a Bluetooth signal and the control chip 19 performs Bluetooth signal processing on the received signal. In another embodiment, other components (not shown in the drawings), such as a transistor, a resistor or a capacitor, are disposed on the control module board 16. In one embodiment, other traces (not shown in the drawings) and other components (not shown in the drawings) are disposed on the first lower surface 165 so the space is well utilized.

Figure 2B:
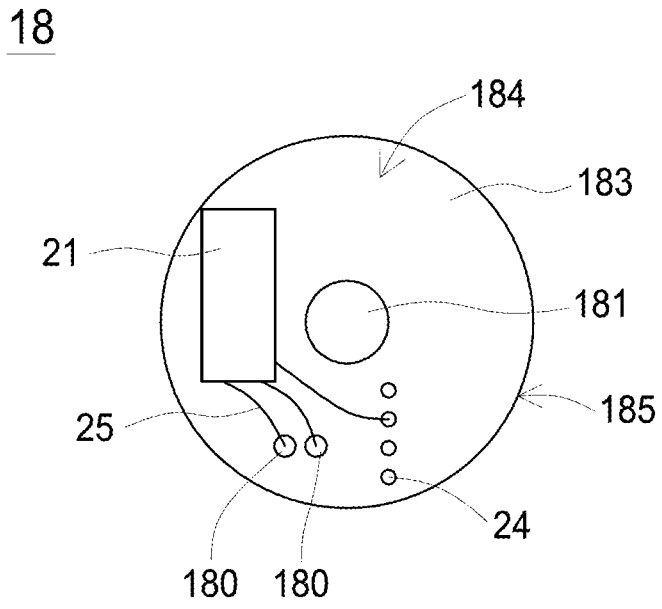
FIG. 2B shows a top view of a driving circuit board in accordance with an embodiment of the present application.

FIG. 2B shows a top view of a driving circuit board in accordance with an embodiment of the present application. Referring to FIG. 2B, the driving circuit board 18 includes a substrate 183, power contacts 180, a receiving part 181, a driving circuit 21, traces 25 and an ejector pin base 24. The substrate 183 includes a second upper surface 184 and a second lower surface 185 opposite to the second upper surface 184. The driving circuit 21, the traces 25 and the ejector pin base 24 are disposed on the second upper surface 184. The lower connecting part 131 passes the second through holes 160 and thus directly contacts the power contacts 180. The lower connecting part 131 is electrically connected to the driving circuit 21 via the traces 25. The supporting pillar 21 passes the third through hole 161 and thus directly contacts the receiving part 181. The power contacts 180 include a metal part penetrating the substrate 183. The ejector pin base 24 is configured to accommodate the ejector pins 22. The ejector pin base includes a metal layer (not show in the drawings) for contacting the ejector pins 22 and the traces 25 so the ejector pins 22 can be electrically connected to the traces 25 via the metal layer. As a result, the internal control signal generated by the control chip 19 can be provided to the driving circuit 21 via the metal layer of the ejector pin base 24 and the traces 25. In one embodiment, the ejector pin base 24 is fixed on the substrate 183 so the ejector pins 22 can be stably disposed on the second upper surface 184 via the ejector pin base 24. In comparison with connecting the ejector pins 22 and the traces 25 by solder, the ejector pin base 24 lowers the probability of open circuit defects induced by movements during manufacturing so the yield is improved. The driving circuit 21 generates a driving signal based on the internal control signal and provides the driving signal to the light source 10 via the lower connecting part 131 to adjust the optical characteristics of the light provided by the light source 10, such as the luminance, color temperature or a flicker frequency of the light provided by the light source. The driving circuit 21 can adjust a characteristic of the driving signal, such as a current peak value, a current period, a voltage period, a duty ratio or a voltage peak value. The optical characteristics of the light provided by the light source 10 can be adjusted by adjusting the current or the voltage of the driving signal. In one embodiment, the driving circuit 21 includes a bridge rectifier, a transistor, a diode, a resistor, a capacitor and a filter. The transistor can be a high electron mobility transistor (HEMT). The diode can be a Zener diode. In one embodiment, the driving circuit 21 includes other components disposed on the second lower surface 185, such as a resistor or a capacitor. The components on the second lower surface 185 can be electrically connected to the traces 25 on the upper surface 184 via a metal layer penetrating the substrate 183. The driving circuit board 18 can receive power by wires (not shown in the drawings) electrically connected to the connector 14 and the details can be referred to the above descriptions.

Referring to FIGS. 1A-1B and FIGS. 2A-2B, a part of the control module board 16 overlaps the driving circuit board 18. The second through holes 160 overlap the power contacts 180 at a first cross section so the lower connecting part 131 passes the second through holes 160 easily and is connected to the power contacts 180. In other words, the first lower connecting portion 131*a* and the second lower connecting portion 131*b* passes different second through holes 160 respectively and are connected to different power contacts 180 respectively. The first lower connecting portion 131*a* and the second lower connecting portion 131*b* are not in direct contact to avoid short-circuit. The ejector pin base 24 accommodates the ejector pins 22 so the ejector pins 22 overlap the ejector pin base 24 at a second cross section. The third through hole 161 overlaps the receiving part 181 at a third cross section so the supporting pillar 11 passes the third through hole 161 and thus the supporting pillar 11 contacts or passes the receiving part 181. Therefore, the driving circuit board 18 carries the supporting pillar 11. In one embodiment, an insulation layer is disposed between the control module board 16 and the driving circuit board 18 so the traces 25 and components on the second upper surface 184 of the driving circuit board 18 do not contact the traces on the first lower surface 165 (not shown in the drawings) or components on the first lower surface 165 (not shown in the drawings). Thus, short-circuit is avoided.

Figure 3A:
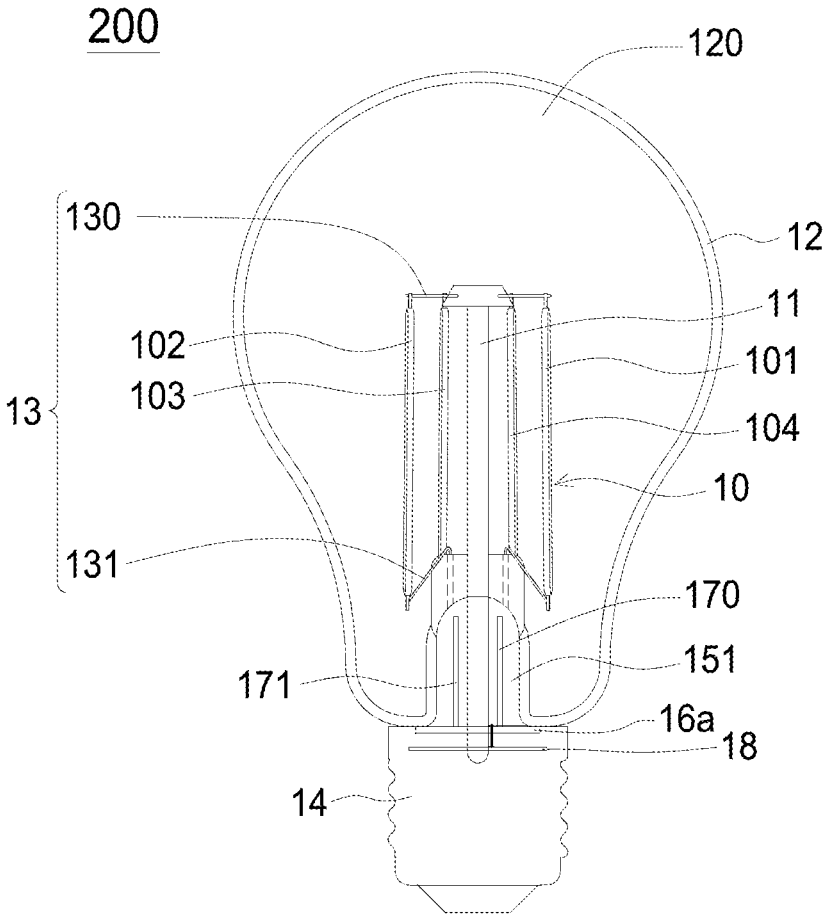
FIG. 3A shows a perspective view of a lamp in accordance with an embodiment of the present application.

FIG. 3A shows a perspective view of a lamp in accordance with an embodiment of the present application. Referring to FIG. 3A, a lamp 200 includes a supporting pillar 11, a housing 12, an antenna 170, a light receiving device 171, a connecting part 13 including an upper connecting part 130 and a lower connecting part 131, a connector 14, a light source 10 including a first light emitting component 101, a second light emitting component 102, a third light emitting component 103 and a fourth light emitting component 104 (not shown in FIG. 3A and can be referred to FIG. 1A), a driving circuit board 18 in the connector 14 and a control module board 16*a* in the connector 14. The housing 12 includes an inner space for accommodating the supporting pillar 11, the light source 10, the upper connecting part 130 and the lower connecting part 131. An accommodation space 151 is composed by the arrangement of the housing 12 and the control module board 16*a*. A part of the supporting pillar 11, the antenna 170 and the light receiving device 171 are disposed in the accommodation space 151. The elements of lamp 200 which have same notation as corresponding elements of lamp 100 can be referred to the above descriptions and are not illustrated again. The lamp 200 can receive an external control signal via the antenna 170. In this embodiment, the housing 12 is light-transparent so the light receiving device 171 can receive a light control signal provided from the outside of the housing 12. The light receiving device 171 which includes a photodiode or a photoresistor can receive the external control signal in form of a visible light, a non-visible light or a combination of a visible light and a non-visible light, such as an ultra-violate light, a purple light, a blue light, a green light, a yellow light, a red light, an infrared light or a white light. The control module board 16*a* converts the external control signal to the internal control signal. The control module board 16*a* is similar to the control module board 16. A difference between the control module board 16*a* and the control module board 16 is that the control module board 16*a* further receives and processes the light signal received by the light receiving device 171, converts the received light signal to the internal control signal and transmits the internal control signal to the driving circuit board 18. As a result, for the lamp 200, the operation of the control module board 16*a* is similar to the control module board 16, but the control module board 16*a* further performs signal processing on the signal provided by the light receiving device 171. The details of the control module board 16 can be referred to the above descriptions. In one embodiment, the light receiving device 171 receives a control signal emitted from an infrared remote controller. The control signal is an infrared light with a peak wavelength within a range of 700 nm~1700 nm. In one example, the peak wavelength is 850 nm, 860 nm or 940 nm.

Figure 3B:
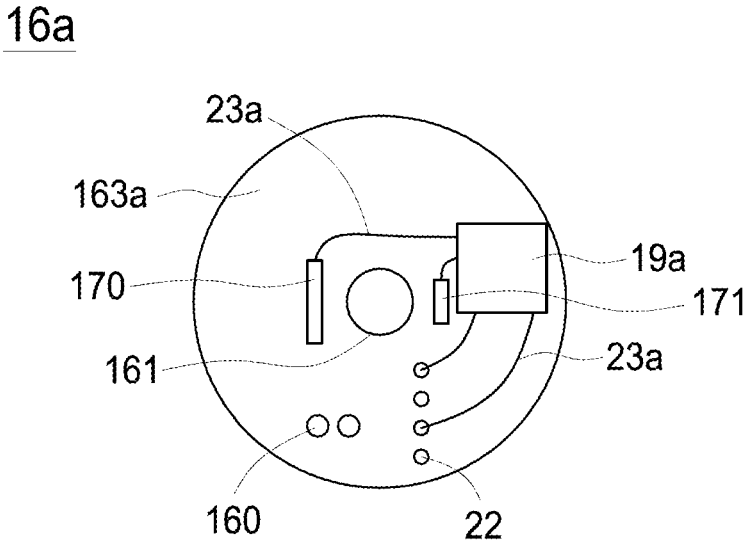
FIG. 3B shows a top view of a control module board in accordance with an embodiment of the present application.

FIG. 3B shows a top view of a control module board in accordance with an embodiment of the present application. Referring to FIG. 3B, the control module board 16*a* includes a substrate 163*a*, second through holes 160, a third through hole 161, a control chip 19*a*, traces 23*a* and ejector pins 22. The antenna 170 and the light receiving device 171 are disposed on the control module board 16*a*. The traces 23*a* are electrically connected to the control chip 19*a*, the antenna 170, the light receiving device 171 and the ejector pins 22. The elements of the control module board 16*a* have same or similar name or notation as corresponding elements of the control module board 16 can be referred to the above description. Referring to FIG. 3B, the antenna 170 and the light receiving device 171 are located at two sides of substrate 163*a* respectively. The antenna 170 and the light receiving device 171 receives signals and provides the received signals to the control chip 19*a* via the traces 23*a* respectively. In other words, the control chip 19*a* receives a signal from the antenna 170 and receives another signal (e.g., a Bluetooth signal, a Wi-Fi signal or a wireless signal of other specifications) from the light receiving device 171, via the traces 23*a*. The control chip 19*a* converts the received signals to the internal control signal. The internal control signal is transmitted to the driving circuit board 18 via the traces 23*a* and the ejector pins 22. The driving circuit board 18 adjusts the optical characteristic of the light provided by the lamp 200 based on the internal control signal. Details of the driving circuit board 18 can be referred to the above descriptions. In one embodiment, the control module board 16*a* further includes other components, such as a transistor, a resistor or a capacitor.

Figure 4A:
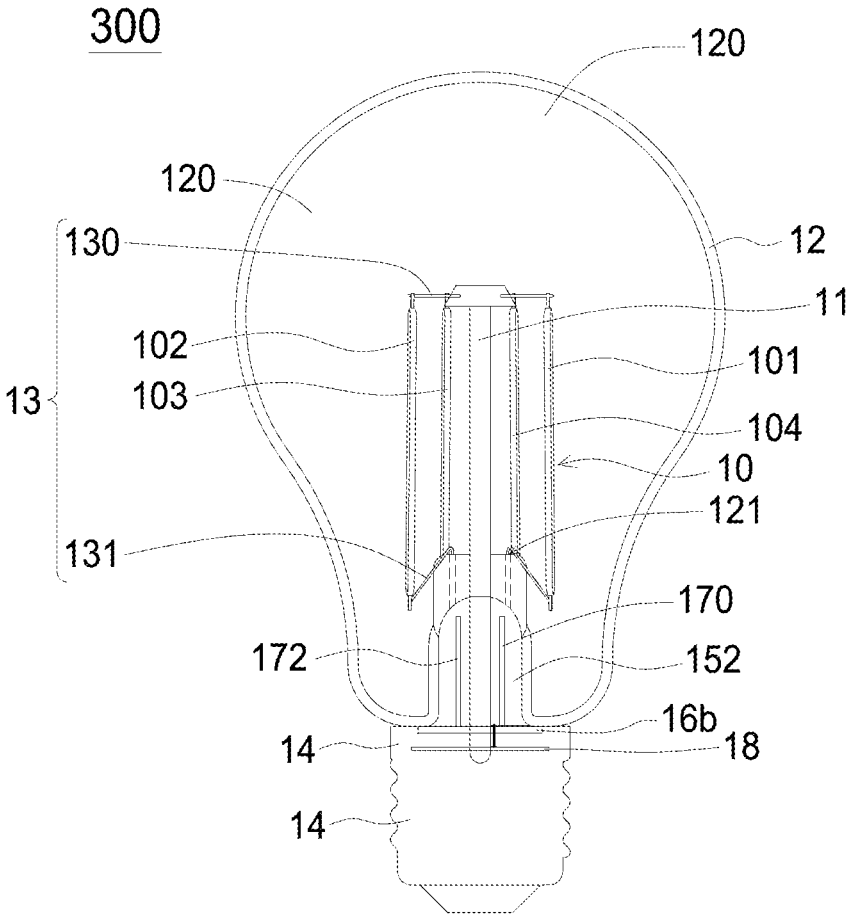
FIG. 4A shows a perspective view of a lamp in accordance with an embodiment of the present application.

FIG. 4A shows a perspective view of a lamp in accordance with an embodiment of the present application. Referring to FIG. 4A, a lamp 300 includes a supporting pillar 11, a housing 12, an antenna 170, a communication device 172, a connecting part 13 including an upper connecting part 130 and a lower connecting part 131, a connector 14, a light source 10 including a first light emitting component 101, a second light emitting component 102, a third light emitting component 103 and a fourth light emitting component 104, a driving circuit board 18 in the connector 14 and a control module board 16*b* in the connector 14. The housing 12 has an inner space 120 for accommodating the supporting pillar 11, the light source 10, the upper connecting part 130 and the lower connecting part 131. The arrangement of the housing 12 and the control module board 16*b* formed an accommodation space. A part of the supporting pillar 11, the antenna and the communication device are disposed in the accommodation space 152. The elements of the lamp 300 have notations same as the corresponding elements of lamp 100 and can be referred to the above description. The lamp 300 receives an external control signal for controlling the lamp 300 (as a first external control signal in the following) via the antenna 170 and transmits a signal via the communication device 172. The communication device 172 can provide a wireless signal or a light signal, wherein the wireless signal can be a Bluetooth signal, a Wi-Fi signal or a wireless signal of other specifications. In addition, the light signal is a visible light, a non-visible light or a combination of a visible light and a non-visible light, such as an ultra-violate light, a purple light, a blue light, a green light, a yellow light, a red light, an infrared light or a white light. In one embodiment, the light signal is an infrared light with a peak wavelength within a range of 700 nm~1700 nm. In other embodiments, the peak wavelength is 850 nm, 860 nm or 940 nm. In another embodiment, the antenna 170 received another external control signal (as a second external control signal in the following) for controlling another electronic device. The received first external control signal and the received second external control signal are transmitted to the control chip (not shown in FIG. 4A) of the control module 16*b* through traces (not shown in FIG. 4A) of the control module board 16*b*. After being processed by control chip, the first external control signal is converted to a first internal control signal and the first internal control signal is transmitted to the driving circuit board 18 for controlling the lamp 300. The second external control signal is converted to a second internal control signal and the second internal control signal is transmitted to the communication device 172 for controlling other electronic devices. The signal conversion and the lamp control can be referred to the above description. The communication device 172 provides a third external control signal for controlling other electronic devices based on the second external control signal, after receiving the second external control signal. In one embodiment, the third external control signal is configured to control an air conditioner, a television, a smart speaker or a video player. In other words, the lamp 300 can be a relay station for transferring control signals so the user can transmit a signal to the lamp 300 and controls other electronic devices without moving around. In one embodiment, the third external control signal and the second external control signal has same optical characteristic, such as peak wavelength, amplitude or frequency. In one embodiment, the third external control signal is an infrared light has a peak length within the range of 700 nm~1700 nm. In one example, the peak wavelength is 850 nm, 860 nm or 940 nm.

Figure 4B:
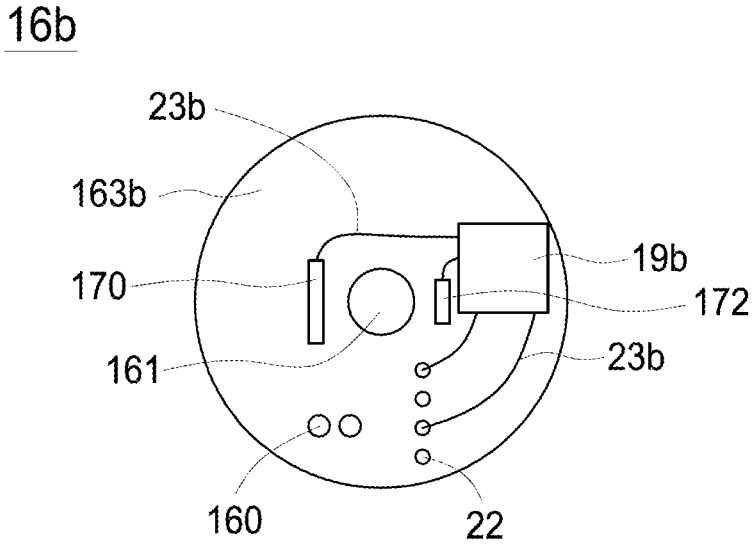
FIG. 4B shows a top view of a control module board in accordance with an embodiment of the present application.

FIG. 4B shows a top view of a control module board in accordance with an embodiment of the present application. Referring to FIG. 4B, the control module board 16*b* includes a substrate 163*b*, second through holes 160, a third through hole 161, control chips 19*b*, traces 23*b* and ejector pins 22. The elements of the control module board 16*b* have same or similar names and notations as the corresponding elements of the control module board 16 can be referred to the above description. Referring to FIG. 4B, the antenna 170 and the communication device 172 are located at two sides of the substrate 163*b* respectively. The antenna 170 receives the first external control signal and provides the first external control signal to the control chip 19*b*. The control chip 19*b* generates a first internal control signal which is provided to the driving circuit board 18 via the traces 23*b* and the ejector pins 22. Besides, the antenna 170 receives the second external control signal and provides the second external control signal to the control chip 19*b*. The control chip 19*b* generates a second internal control signal which is provided to the communication device 172 via a of the traces 23*b*. The communication device 172 generates a third external control signal for controlling other electronic devices based on the second external control signal. In one embodiment, the communication device 172 is a light source can provide a visible light, a non-visible light or a combination of a visible light and a non-visible light, such as an ultra-violate light, a purple light, a blue light, a green light, a yellow light, a red light, an infrared light or a white light. In one embodiment, the communication device 172 is a wireless network device which can provide a Bluetooth signal, a Wi-Fi signal or a wireless signal of other specifications.

Figure 4C:
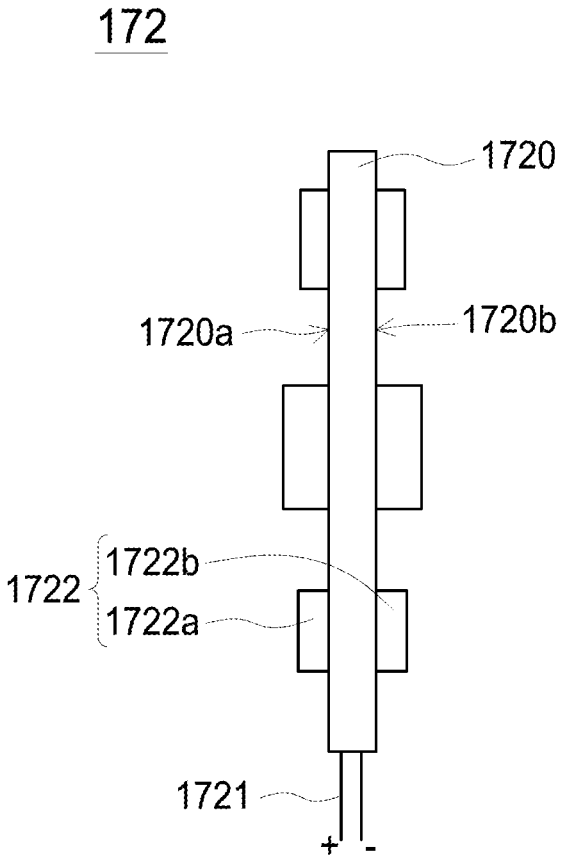
FIG. 4C shows a schematic diagram of a communication device in accordance with an embodiment of the present application.

FIG. 4C shows a schematic diagram of a communication device in accordance with an embodiment of the present application. Referring to FIG. 4C, the communication device 172 includes a substrate 1720, a fifth light source 172 and a connecting end 1721. The substrate 1720 includes a first surface 1720*a* and a second surface 1720*b*. The fifth light source 1722 includes a light source 1722*a* disposed on the first substrate 1720*a* of the substrate 1720 and a light source 1722*b* disposed on the second surface 1720*b* of the substrate 1720. A second internal control signal is received via the circuit (not shown in the drawings) on a surface of the substrate 1720, and a third external control signal is provided based on the second internal control signal. The substrate 1720 is connected to the control module board 16*b* via the connecting end 1721. In one embodiment, the fifth light source 1722 is only disposed on the first surface 1720*a* or only disposed on the second surface 1720*b*. In one embodiment, the light source 1722 includes a III-V group compound semiconductor material, such as AlGaInP which can be represented by a chemical formula: $(Al_{y1}Ga_{(1-y1)})_{1-x3}In_{x3}P$ with $0 \leq x3 \leq 1$ and $0 \leq y1 \leq \leq 1$. The compound semiconductor is capable of emitting an infrared light having a peak length between 700 nm and 1700 nm.

Based on the above descriptions, the present application provides lamps 100, 200, 300 capable of remote control. Users can deliver a control signal to control the lamps by a mobile phone or a remote controller. Furthermore, the lamps can be a relay for transferring a control signal to other electronic devices.

It will be apparent to those having ordinary skill in the art that various modifications and variations can be made to the devices in accordance with the present disclosure without departing from the scope or spirit of the disclosure. In view of the foregoing, it is intended that the present disclosure covers modifications and variations of this disclosure provided they fall within the scope of the following claims and their equivalents.

What is claimed is:

1. A light emitting apparatus, comprising:
a housing, comprising an inner space;
a connector, connected to the housing;
a light source, located in the inner space;
a control module board, located in the connector, wherein an accommodation space is formed by the housing and the control module board; and
an antenna, located in the accommodation space,
wherein the antenna does not penetrate the housing and is not in the inner space.

2. The light emitting apparatus according to claim 1, wherein the antenna comprises a substrate and a reflecting layer covering the substrate.

3. The light emitting apparatus according to claim 1, further comprising a supporting pillar penetrating the housing.

4. The light emitting apparatus according to claim 3, further comprising an upper connecting part and a lower connecting part which are connected to the supporting pillar.

5. The light emitting apparatus according to claim 1, further comprising a driving circuit board surrounded by the connector.

6. The light emitting apparatus according to claim 5, wherein the control module board comprises an ejector pin electrically connected to the driving circuit board.

7. The light emitting apparatus according to claim 1, wherein the antenna is protruded in respect to the control module board.

8. The light emitting apparatus according to claim 1, further comprising a communication device disposed in the accommodation space.

9. The light emitting apparatus according to claim 8, wherein the communication device provides visible light or non-visible light.

* * * * *